US007052778B2

(12) United States Patent
Sorgi

(10) Patent No.: US 7,052,778 B2
(45) Date of Patent: May 30, 2006

(54) METHOD AND APPARATUS FOR COLD FORGING A TRAILER HITCH RECEIVING HOUSING

(76) Inventor: Eugene Angelo Sorgi, 314 Butler Ct., Marshall, MI (US) 49068

( * ) Notice: Subject to any disclaimer, the term of this patent is extended or adjusted under 35 U.S.C. 154(b) by 0 days.

(21) Appl. No.: 11/171,911

(22) Filed: Jun. 30, 2005

(65) Prior Publication Data

US 2005/0236810 A1 Oct. 27, 2005

Related U.S. Application Data

(62) Division of application No. 10/403,386, filed on Mar. 28, 2003, now Pat. No. 6,931,906.

(60) Provisional application No. 60/368,637, filed on Mar. 28, 2002.

(51) Int. Cl.
*B60D 1/00* (2006.01)

(52) U.S. Cl. ..... 428/600; 428/582; 428/586; 428/599; 280/495

(58) Field of Classification Search ..... None
See application file for complete search history.

(56) References Cited

U.S. PATENT DOCUMENTS

| | | | | |
|---|---|---|---|---|
| 1,966,053 | A * | 7/1934 | Squires | 72/342.1 |
| 3,833,984 | A * | 9/1974 | Dietzel | 29/890.15 |
| 4,442,693 | A * | 4/1984 | Walter et al. | 72/316 |
| 5,203,194 | A * | 4/1993 | Marquardt | 72/316 |
| 6,408,672 | B1 * | 6/2002 | Roe et al. | 72/370.11 |
| 6,796,574 | B1 * | 9/2004 | Palmer | 280/495 |
| 2005/0005667 | A1 * | 1/2005 | Greczanik et al. | 72/370.03 |

* cited by examiner

*Primary Examiner*—John J. Zimmerman
(74) *Attorney, Agent, or Firm*—Synnestvedt Lechner & Woodbridge LLP

(57) ABSTRACT

A cold forging process and apparatus for reinforcing an end of a rectangular tube, including a close fitting, rectangular upper mandrel that inserts into the tubing. The upper mandrel has flared corners at the end attached to the upper die. As the upper die is moved under pressure towards the lower die, the flared corners of the mandrel makes contact with the inner surface of the tube. This ensures that the tube begins to deform outward before the rest of the upper die contacts it. As the upper die is pressed towards contact with the lower die, the end of the tube is cold formed into a collar. The dies are then moved apart and the cold-formed tube removed. A lower mandrel positions and retains the die during forming. After forming the lower mandrel is used to eject the formed part, which may for instance be a trailer hitch housing.

8 Claims, 9 Drawing Sheets

METHOD AND APPARATUS FOR COLD FORGING A TRAILER HITCH RECEIVING HOUSING

CROSS REFERENCE TO RELATED APPLICATIONS

This application is a Divisional of Application Ser. No. 10/403,386, filed Mar. 28, 2003 now U.S. Pat. No. 6,931,906 issued on Aug. 23, 2005 to E. Sorgi entitled "Method and Apparatus for cold forging a trailer hitch receiving housing", which in turns claims priority from U.S. Provisional Application Ser. No. 60/368,637, filed on Mar. 28, 2002 and entitled "Cold Form Process to Make a Trailer Hitch" by Eugene Angelo Sorgi, the entire contents and substance of which are hereby incorporated in total by reference.

FIELD OF THE INVENTION

The present invention relates to processes for deforming metal tubes. More specifically, the invention relates to a method and apparatus for cold forming an end of a pipe to provide a reinforced portion or collar.

BACKGROUND OF THE INVENTION

In the automotive industry, vehicles are often fitted with a hitch assembly to which a trailer may be attached. Such an assembly usually includes a hitch receiver tube and a hitch bar slidably engaged within same. The bar hitch includes a ball onto which the trailer is attached. The hitch receiver tube, which is typically made of low carbon steel, is mounted on the vehicle frame by a suitable means such as brackets and the like and is normally provided at its terminal end (i.e. the end into which the hitch bar is inserted) with a reinforcing collar. Although such a collar increases the strength of the tube, various problems have been found with this structure. For example, the reinforcing collar must be welded on the bar thereby reducing its aesthetic appeal and creating heat affected zones in the material which may lead to service problems. Further, since a complete seal is usually not achieved, the accumulation of water and salt within any spaces accelerates the corrosion of the entire structure.

Various solutions have been proposed to address the above issues. One example is described by Marquardt in U.S. Pat. No. 5,203,194, which is hereby incorporated by reference. Marquardt teaches a process for reinforcing the terminal end of a hitch trailer. A significant disadvantage of the Marquardt process is the requirement for heating a tube to approximately 1800° F. before forming the tube into the required shape. As will be appreciated, such heating greatly increases the time and cost of producing each piece. Further, the heating of the tube results in de-alloying and oxidation of its surface. The deposits resulting from the heating or welding must be removed, further increasing the production time and cost. In addition, the heating of the tube deteriorates the structural integrity of the material by for instance, annealing the material, thereby resulting in weakness.

Another example is described by Roe et. al in U.S. Pat. No. 6,408,672, which is hereby incorporated by reference. The Roe et al. process describes a process for cold forming the ends of metal tubes to reinforce them. The tube is placed in a die cavity such that a portion is left outside the cavity. A mandrel is inserted into the tube. The mandrel includes a section that is adapted to bear against the portion of the tube outside of the cavity and to deform the tube. The deformation process is conducted without heating the tube and results in the tube being folded upon itself within a recess in the die cavity.

Simple cold forming processes, such as that described in Roe et. al., have a number of significant problems. One is the unpredictability of the initial direction of deformation. This means that slight deviations in positioning or structure of the initial tube, or the simple flat deforming plate, can result in the tube folding in the wrong direction or in multiple directions, creating laps, and thereby ruining the product. This is especially problematic in the corners of the tube being formed. A second problem with simple dies is that the cold-formed part is liable to stick in the die cavity. Another problem is that under the high pressures of cold forming, which are typically in the range of 165–320 tons for forming 2.5 inch square tubing with 0.25 inch walls, the die cavity is vulnerable to exploding. A further problem stems from the need for an inner mandrel that is a close fit to the inner dimensions of the tube so as to prevent it from buckling inwards during the forming process. Small amounts of the tubing metal weld to the mandrel and cause scoring of the housing when they subsequently break off. Any or all of these problems can cause costly delays and/or wastage.

Thus, there is a need for a receiver tube forming process that overcomes the deficiencies in the known methods.

SUMMARY OF THE INVENTION

The present invention is a cold forging process and apparatus for reinforcing an end of a rectangular tube by forming a collar in a way that overcomes the deficiencies in the known methods and apparatus, including those described above.

In a preferred embodiment of the invention, a square tube is held in position in a lower die by a lower mandrel, then cold formed by introducing a close fitting, square upper mandrel into the tubing. In one embodiment of the invention, the upper mandrel may even be slightly larger than the tubing, thereby helping size or hold the size of the tubing. The square mandrel has flared corners and is attached to an upper die, having an appropriately shaped upper forge cavity. The square mandrel may also slightly tapered so that, as the upper die is moved under pressure towards the lower die, the first point of contact between the outer surface of the mandrel and the inner surface of the tubing occurs substantially where the mandrel enters the tubing or at the point where the collar is to be formed. As the upper die continues to move towards the lower die, the flared corners of the mandrel contact the inner surface of the tube, and begin forming radii in the four corners of the collar of the square tube. This contact with the flared corners of the mandrel ensures that when the top, closed portion of the upper die comes into contact with the top of the tube, the walls deform outwards. As the upper die is pressed towards the lower die, the end of the tube is forced into contact with the inner surface of the upper die and cold formed into a collar. The upper and lower dies never quite touch, although they do come close together, and may even end the cycle as close as a few thousands of an inch apart. The dies are then moved apart and the cold-formed tube removed from the lower die when the lower mandrel is forced upwards by for instance, being driven upwards by a wedge and pin assembly.

In one embodiment of the invention, the lower die is slightly tapered to further help prevent the tube sticking in the lower die.

In one embodiment of the invention, the lower mandrel transition to a flat base has a radiussed inner joint. This radius ensures that the tube does not deform inwards at its lower end when forced down under pressure towards the flat base of the lower mandrel.

The advantages of the present invention include an end product with a better surface finish that has none of the oxidation or pitting associated with welding or hot forging occurs. The end product also has a better wearing, higher hardness surface because no de-alloying, decarburization or annealing associated with welding or hot forging occurs.

A further advantage of the present invention is that the cold working that forms the collar results in increased yield strength of the material without affecting the tensile strength. This means a finished product that has the same maximum load tearing strength, but is significantly more resistant to bell mounting in operation, as compared to for instance, trailer hitch housings made by the methods cited in the prior art.

Another advantage of the present invention is that when the tubing is seam welding tubing, as is common in the manufacture of many tube related items, the cold forming process of this invention is a very severe test of the weld quality. Any weak or unacceptable welds, including welds that are significantly off-center, will be revealed by splitting during the cold forming process of this invention.

DETAILED DESCRIPTION

The invention will now be described with reference to the figures, in which like numbers are used to depict like elements.

Figure 1:
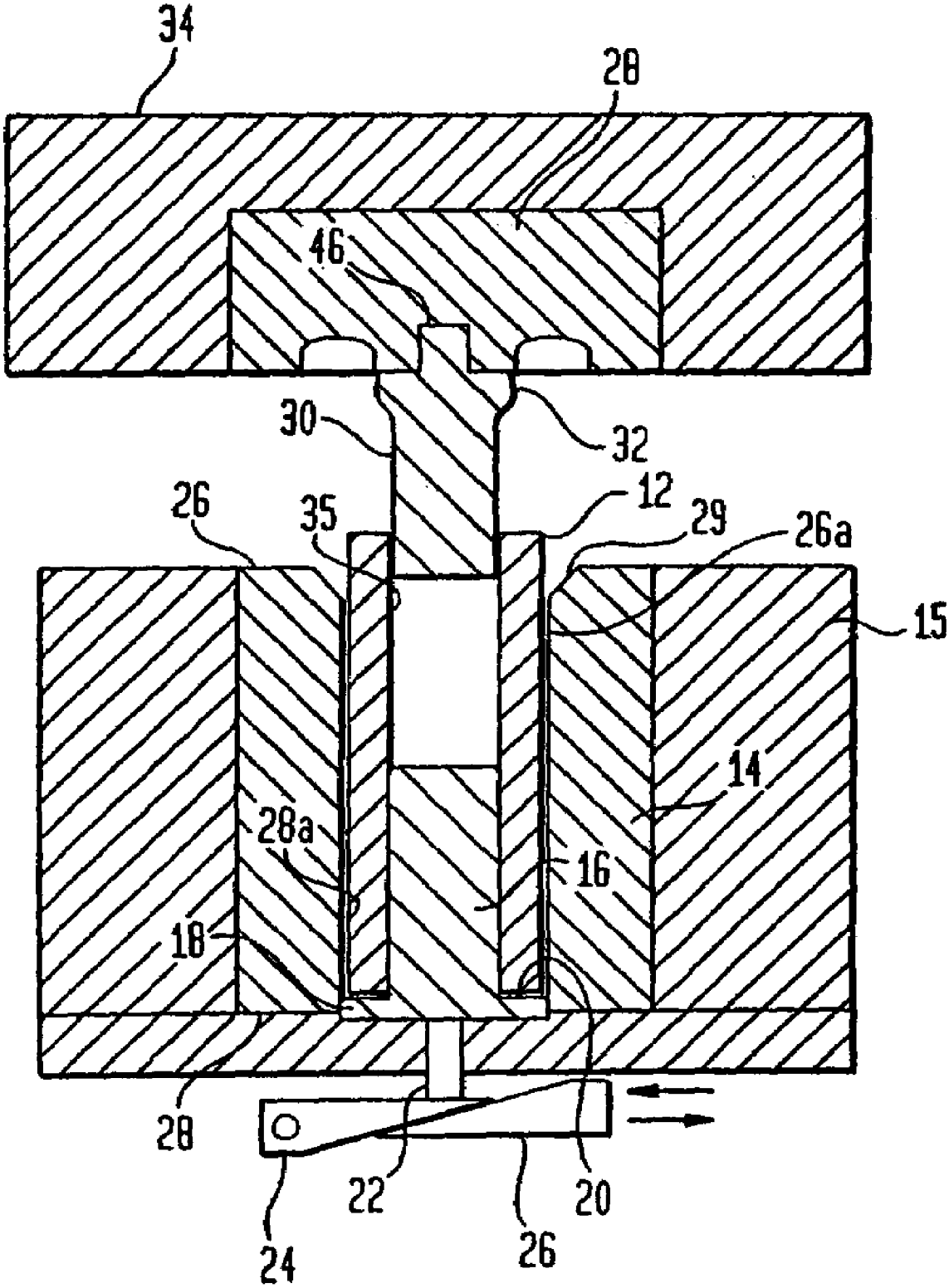
FIG. 1 is a diagonal cross-section of the cold forming apparatus of this invention.

FIG. 1 is a cross-section of the apparatus of this invention in the first stage of operation of the method of this invention, the section being taken diagonally through the corners of the tube 12 being formed. A rectangular tube 12 is shown held in a lower die 14 that has a chamfered lip 29 at its upper end, the chamfer being at approximately 45 degrees to the walls of the die. In the preferred embodiment, the lower die 14 is made from S7 steel, which is a well-known general purpose, air hardening, tool steel with a high resistance to impact and shock. The lower die 14 is encased in a softer steel, such as, but not limited 4140 steel, a well-known alloy having good ductility and high strength. The purpose of encasing the lower die 14 in a steel of greater ductility is to lessen the risk of the die cracking or exploding during processing. The lower die 14 may be tapered, so that the top end 26 has a wider opening than the lower end 28. In the preferred embodiment the taper may be as little as about 0.2 degrees. It will be understood by one skilled in the art that the degree and extent of the taper may be varied to adjust for factors such as, but not limited to, the types of steel and pressures used in the cold forming. The purpose of the taper in the lower die 14 is to facilitate removal of the formed tube 12 after processing.

The lower die 14 contains a lower mandrel 16 having a flat base section 18 with radiused inner abutment 20. The function of radiused inner abutment 20 is to ensure that when tube 12 is forced down onto the top of lower mandrel 16's flat base section 18, tube 12 does not deform inwards and jam against lower mandrel 16. Lower mandrel 16 is used to eject tube 12 after the forming process by being forced upwards by pin 22 being driven by horizontally sliding wedge 26 driving rotationally fixed wedge 24 upwards. The lower mandrel 16 is typically made from steel alloys that are tough, hardenable and have high wear resistance such as, but not limited to, D-2 and M-4 steel.

The upper die 28 contains a top or upper mandrel 30 attached centered on the upper die 28. The top mandrel 30 has flared corners 32, clearly distinguishable in the diagonal cross-section. The purpose of the top mandrel 30 is two-fold. The upper mandrel 30 is sized to be a close fit to the inside surface of the tube 12 being formed, and prevents tube 12 from buckling inwards during processing. After the top or upper mandrel 30's outer surface makes contact with the inner surface of tube 12 at level 34, the flared corners or ears 32 of the mandrel 30 are the next point of contact between tube 12 and mandrel 30. The flared corners 32 are sized and shaped so as to ensure that the tube 12 deforms outward to start assuming the desired shape of the end product. At a latter stage, the top of the tube touches the upper die cavity, which reverses the movement of metal from away from the tube center back towards the tube center. The mandrel 30 is made from steel alloys that are tough, hardenable and have high wear resistance such as, but not limited to, D-2 and M-4 steel. The mandrel 30 is threadably or otherwise attached to the upper die insert 28. Upper die insert is bolted or otherwise attached to encasing support 34. Upper die insert 28 is preferably made from a steel that is hardenable and has lower friction, such as but not limited to, M-2 steel. The encasing support is a made of a good ductility, high strength steel such as, but not limited to, 4140 steel to add in preventing splitting or explosion of upper die insert 28.

Not shown in FIG. 1 is the press, which may be, but is not limited to, a mechanical or hydraulic press or other suitable pressure providing means, used to move the upper die 28 towards lower die 14 and so cold or upset form tube 12 without heat or lubricant. The press may exert pressure of up to at least 1000 tons. In the preferred embodiment, when cold forming SAE 1018–1021 mild steel, 2.5 inch welded tube with 0.25 inch walls, the press operates in the range of 280 to 320 tons. However, if tubing were to be of smaller cross-section, smaller hydraulic presses are needed. For instance, it is estimated that for similar tubing scaled to ¾ of an inch by ¾ of an inch, only 80 tons of pressure would be needed for forming. Conversely, larger section tubing would require larger pressure. For instance, it is estimated that for similar tubing scaled to 6 inches by 6 inches, presses capable of exerting between 900 and 1000 tons of pressure are needed.

Figure 2A:
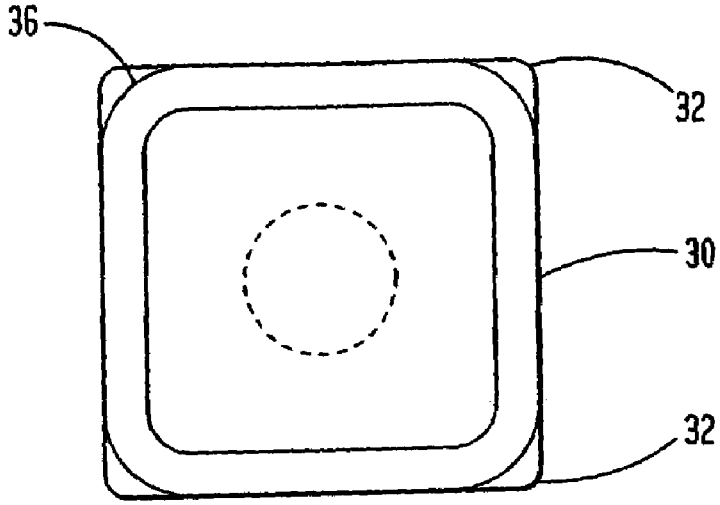
FIG. 2A is a plan view of a top mandrel, viewed from the bottom.

FIG. 2*a* is a plan view of the top or upper mandrel 30, viewed from the bottom, showing the ears or flared corners 32. In the preferred embodiment, the ears or flared corners 32 are formed by having less of a radius to each of the corners of the mandrel. This method of forming the ears can be appreciated from the fact that the corner radius 36 of the upper mandrel, substantially through out the rest of the upper mandrel, is sized to closely match the inner radius of the tube 12 that is being formed. Basically, the function of the ears is to start the tube deforming outwards in the proper direction. This is followed later by the upper die cavity moving the material towards the center of the tube, with the corners literally pulling the tube walls to the final collar configuration.

Figure 2B:
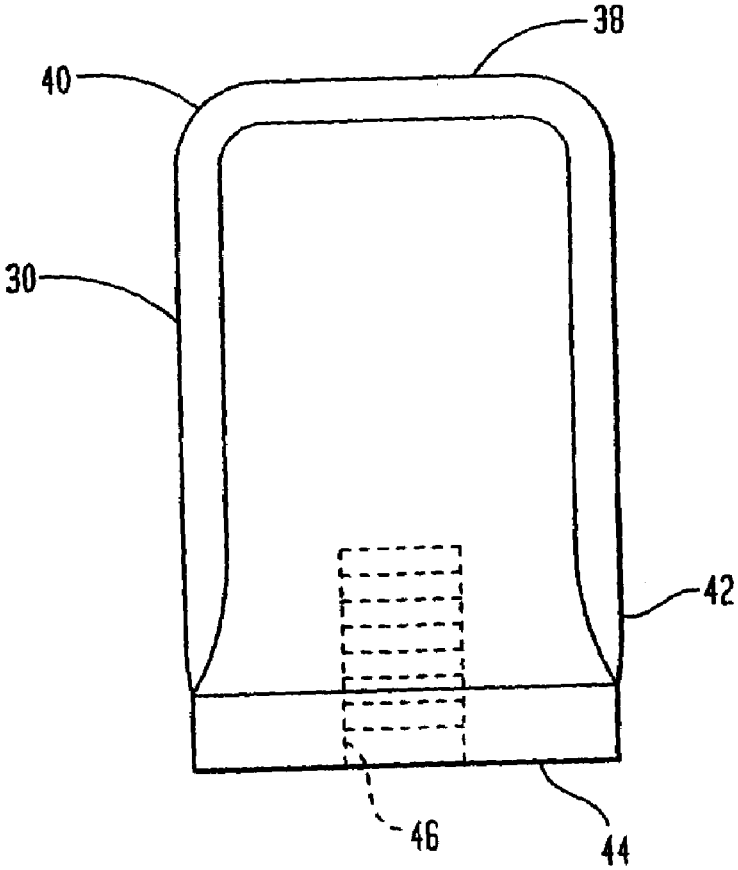
FIG. 2B is a side view of a top mandrel.

FIG. 2*b* is a side view of the top or upper mandrel 30, taken parallel to the flat side of the mandrel. Upper mandrel 30 is tapered so that end 38, in addition to having radiused corners 40, is narrower than at waist 42. For instance in one embodiment of the invention the mandrel is 2.12 inches wide at the waist 42 and narrows down to 2.08 inches at end 38, 2.7 inches away, when raduis 40 is discounted. Upper mandrel 30 is also tapered from waist 42, which is roughly the top level of ears 32, towards the dye-attaching end 44. In one embodiment of the invention, the dye-attaching end is 2.06 inches, when the waist 42 is 2.12 inches wide and 0.4 inches away. In the preferred embodiment upper mandrel 30 has threaded hole 46 for attaching to upper die 28 (not shown in FIG. 2*b*).

Figure 3:
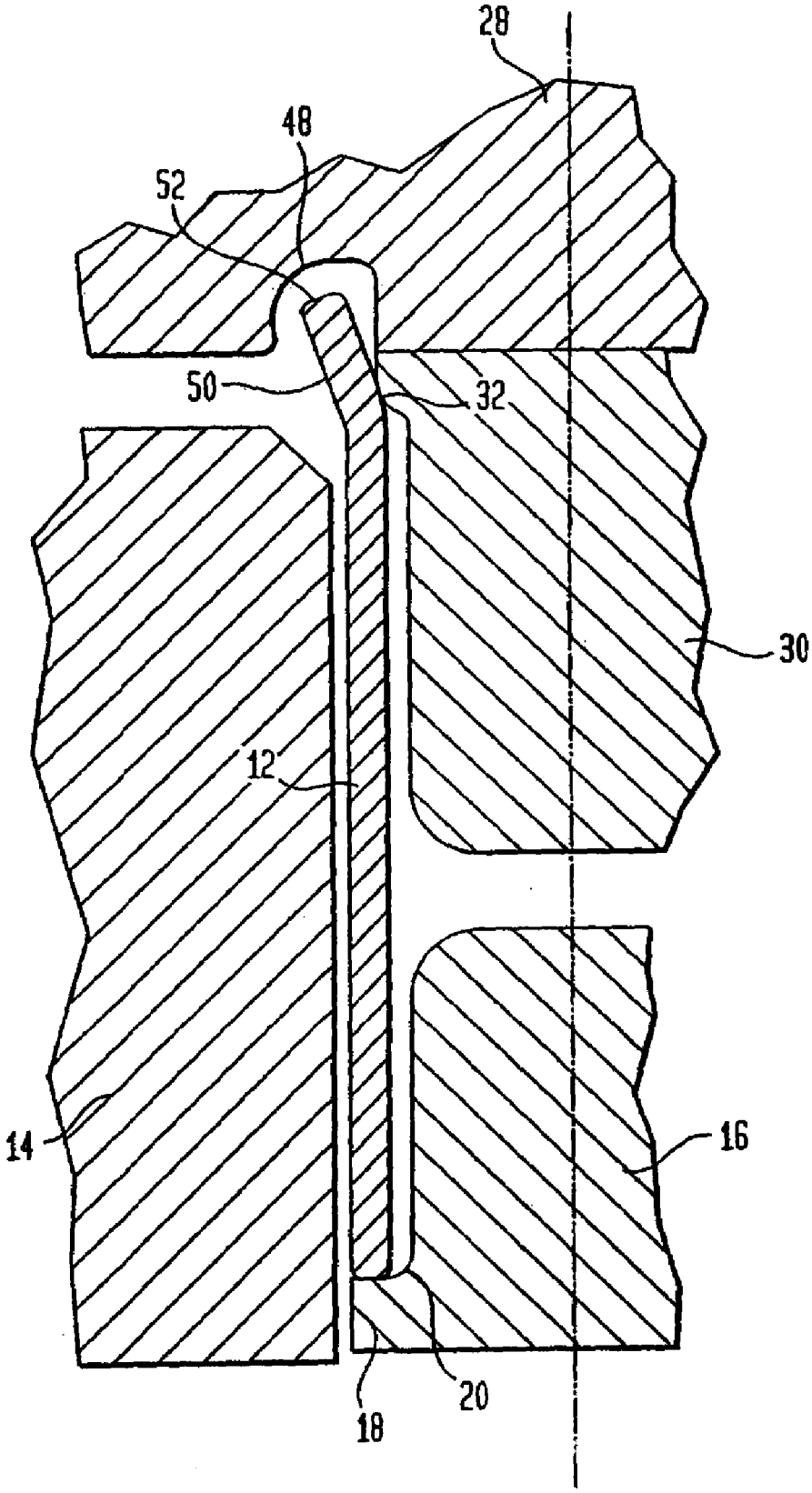
FIG. 3 is a partial sectional view of the forming apparatus and tube taken on the diagonal of the tube at an early stage of forming.

FIG. 3 is a partial sectional view of the forming apparatus and tube 12 taken on the diagonal of the tube at an early stage of forming. At this stage mandrel ears 32 begin forming radii in the four corners of the square tube 12, beginning the formation of reinforcing collar 50. FIG. 3 also shows lower mandrel 16 having a flat base section 18 with radiused inner abutment 20, along the line where the sides of the mandrel that are shaped to fit inside of tube 12 join the top of the mandrel's flat base, intended to prevent longitudinal movement of the tube 12 during forming. In FIG. 3 the upper forge or die cavity 48 is shown just beginning to contact tube 12 at point 52.

Figure 4:
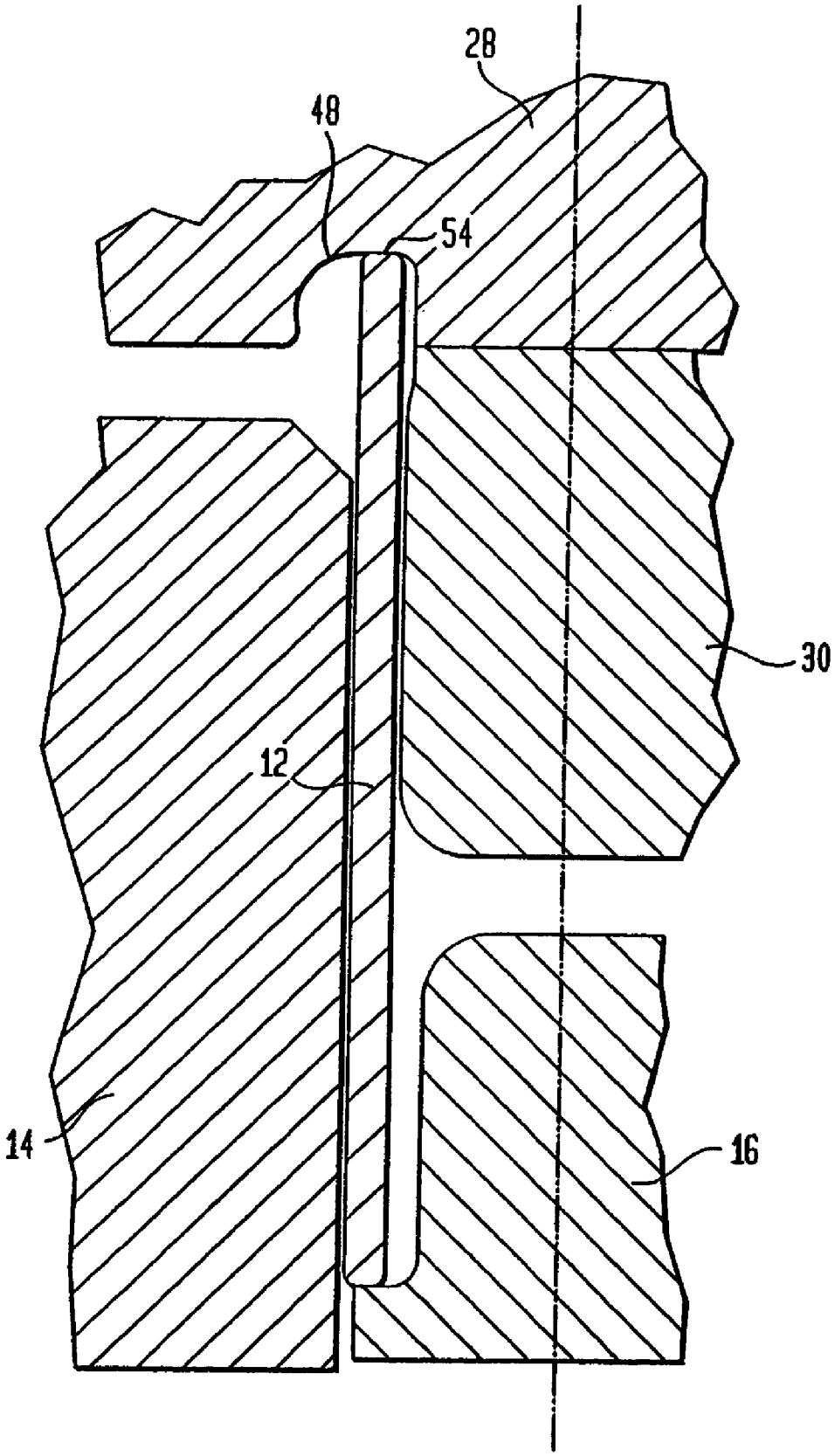
FIG. 4 is a partial sectional view of the forming apparatus and tube taken parallel to the side of the tube and between the corners of the tube, at an early stage of forming.

FIG. 4 is a partial sectional view of the forming apparatus and tube 12 at the same early stage of forming shown in FIG. 3. However, in FIG. 4, the sectional view is taken parallel to the side of the tube. Upper forge or die cavity 48 is shown just beginning to contact tube 12 at point 54.

Figure 5:
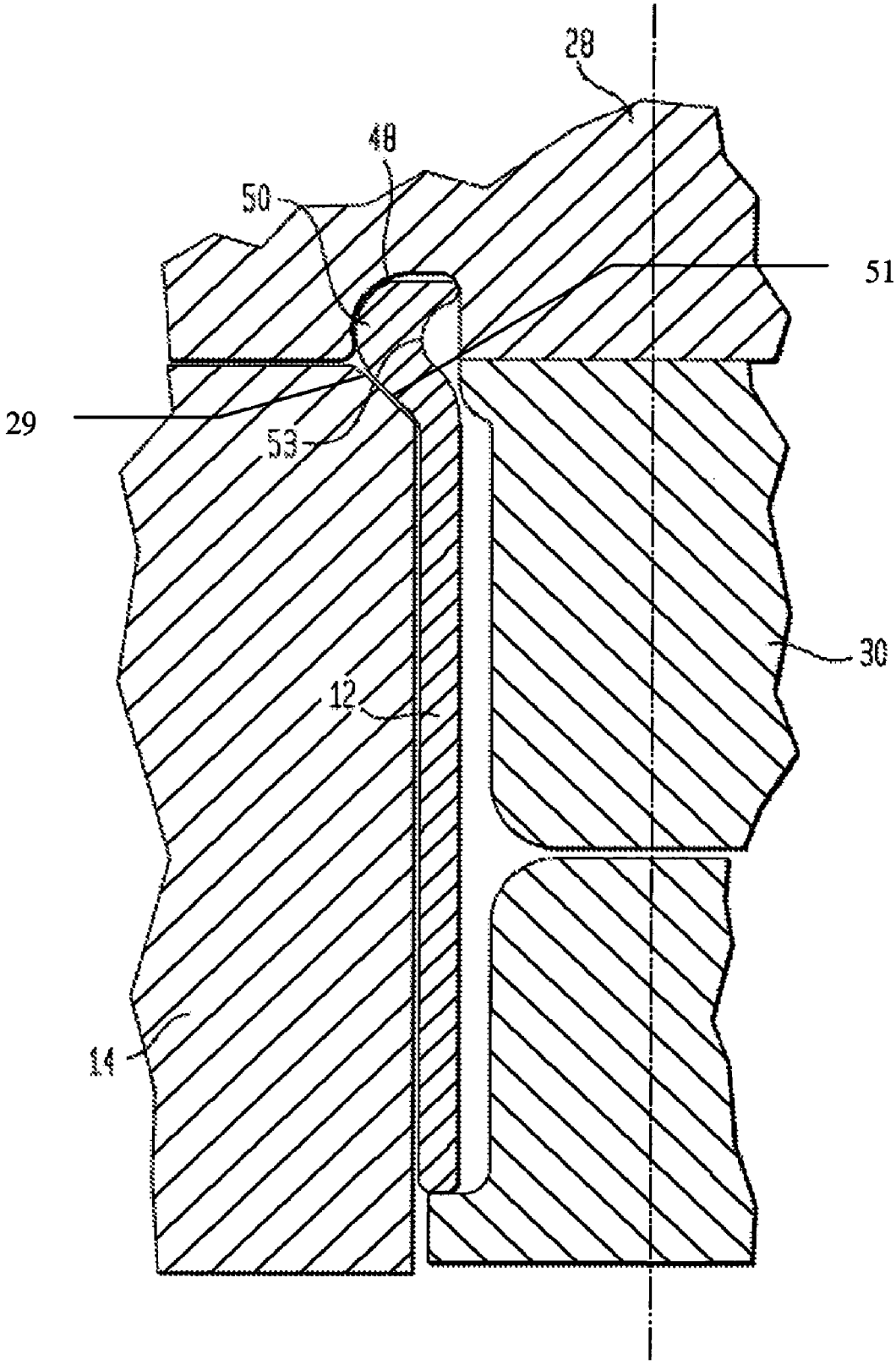
FIG. 5 is a partial section view of the forming apparatus and tube taken on the diagonal of the tube at a late stage of forming.

FIG. 5 is a partial section view of the forming apparatus and tube 12 taken on the diagonal of the tube at a late stage of forming. Upper forge tooling or die 28 is now close to contact with lower forge tooling or die 14. The upper and lower die tooling 28 and 14 are prevented from contacting limits set by spacers in the hydraulic press (not shown) but approach to within a few thousandths of an inch of each other. At this stage reinforcing collar 50 is substantially complete, with it's outer surface essentially conforming to the inner surface of the upper die 28's upper forge or die cavity 48. This results in the reinforcing collar having a flat chamfered base 51, angled at about 45 degrees and abutting the tube portion of the collar formed by conforming to the chamfered lip 29 at the upper end of the die. The inner surface 52 of collar 50 is a concave surface, separated from upper die tooling 28.

Figure 6:
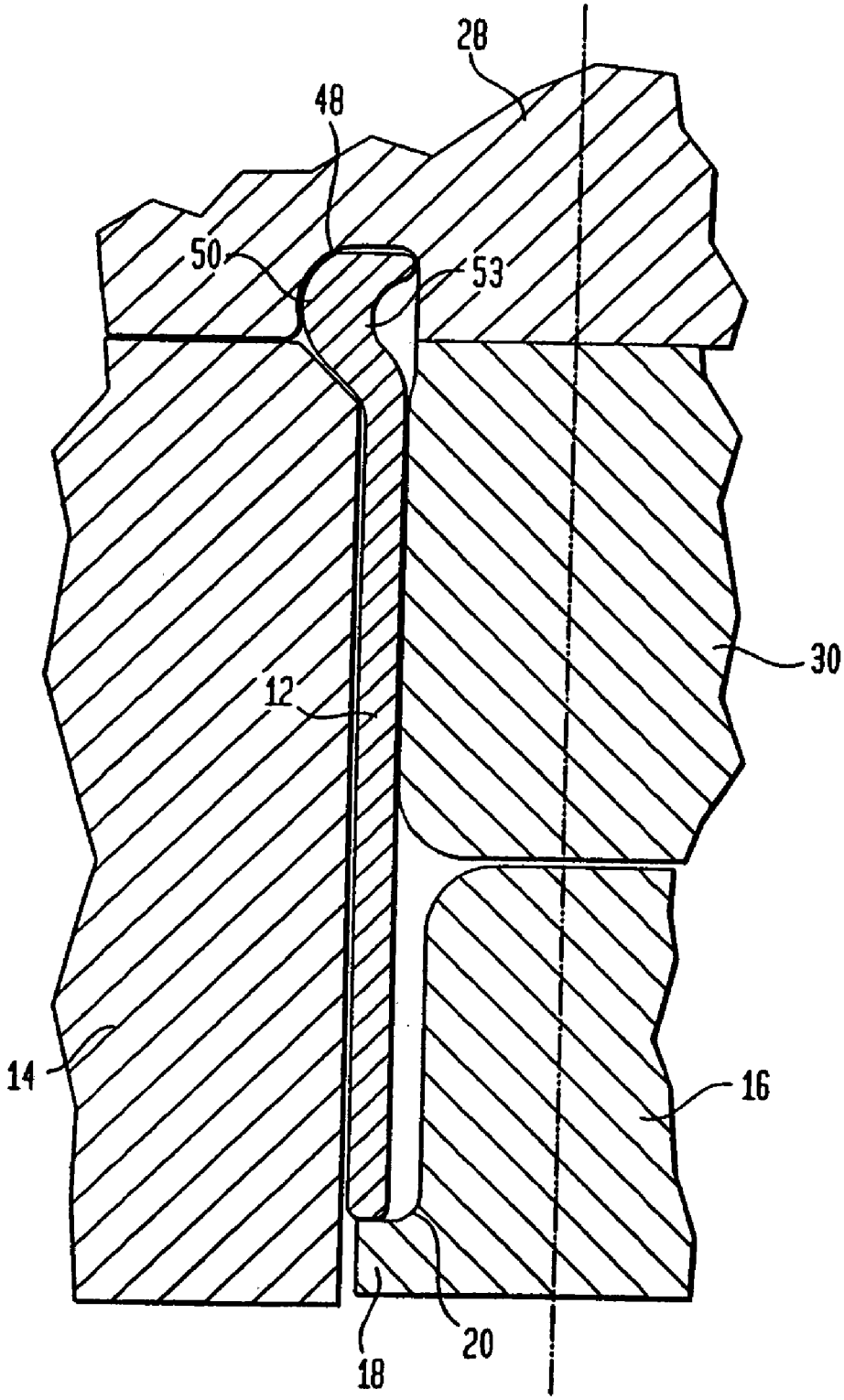
FIG. 6 is a partial sectional view of the forming apparatus and tube taken parallel to the side of the tube and between the corners of the tube, at a late stage of forming.

FIG. 6 is a partial sectional view of the forming apparatus and tube 12 at the same late stage of forming shown in FIG. 5. However, the sectional view in FIG. 6 is taken parallel to the side of the tube 12. At this stage reinforcing collar 50 is substantially complete, with it's outer surface essentially conforming to the inner surface of the upper die 28's upper forge cavity 48. The inner surface 52 of collar 50 is a concave surface, separated from upper die tooling 28.

Figure 7:
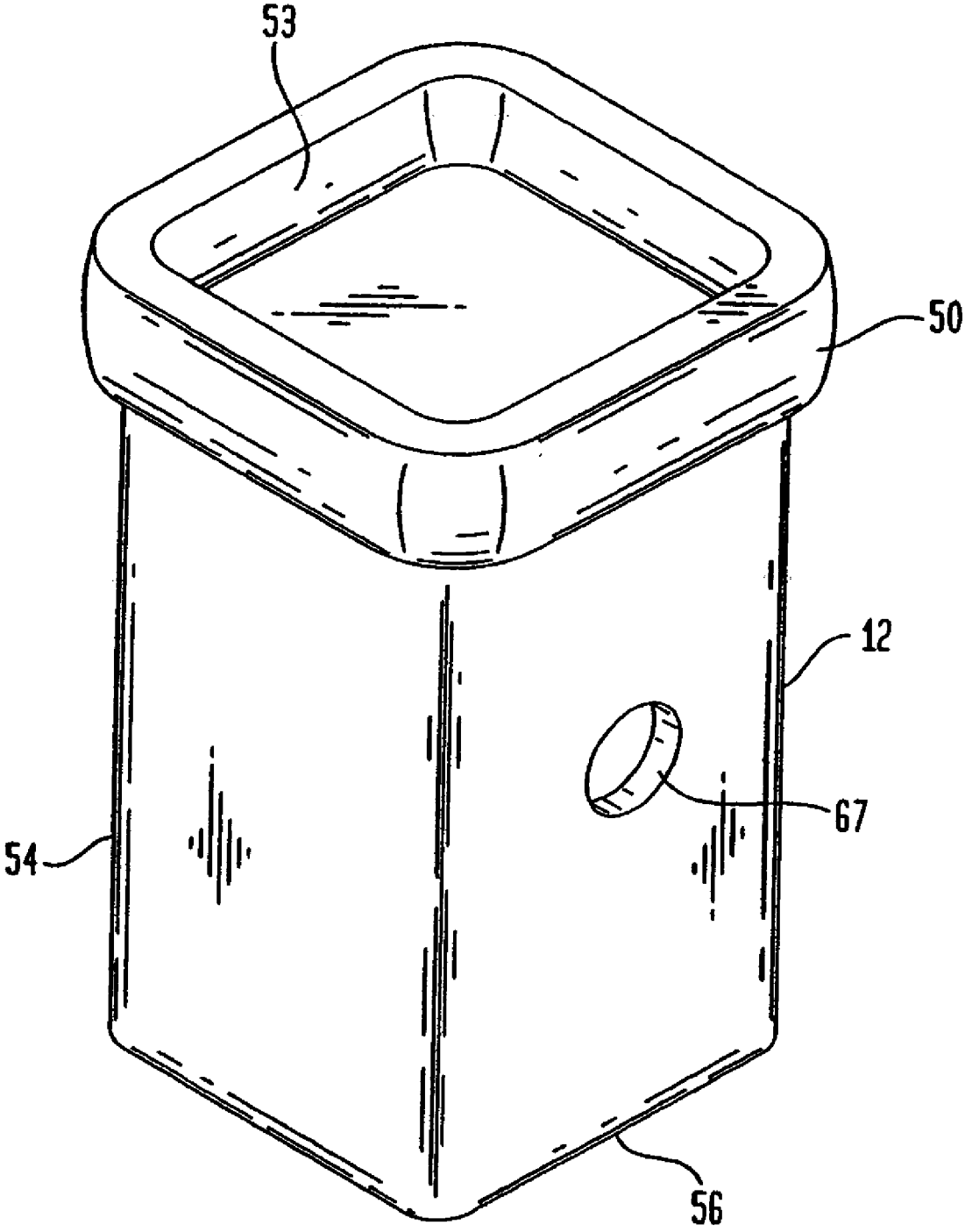
FIG. 7 is an isometric view of a tube formed by the apparatus and process of this invention.

FIG. 7 is a perspective drawing of a trailer hitch receiving housing 54 formed by the method and apparatus of this invention. Original tubing 12 has one saw cut end or surface 56. The other end has a collar 50 formed by cold forming or upsetting. The collar 50 has a concavity 53 on it's inner surface. The products formed form the process benefit from a number of advantage of the method including better surface finish because none of the oxidation or pitting associated with welding or hot forging occurs and a better wearing, higher hardness surface because no de-alloying, decarburization or annealing associated with welding or hot forging occurs.

Figure 8:
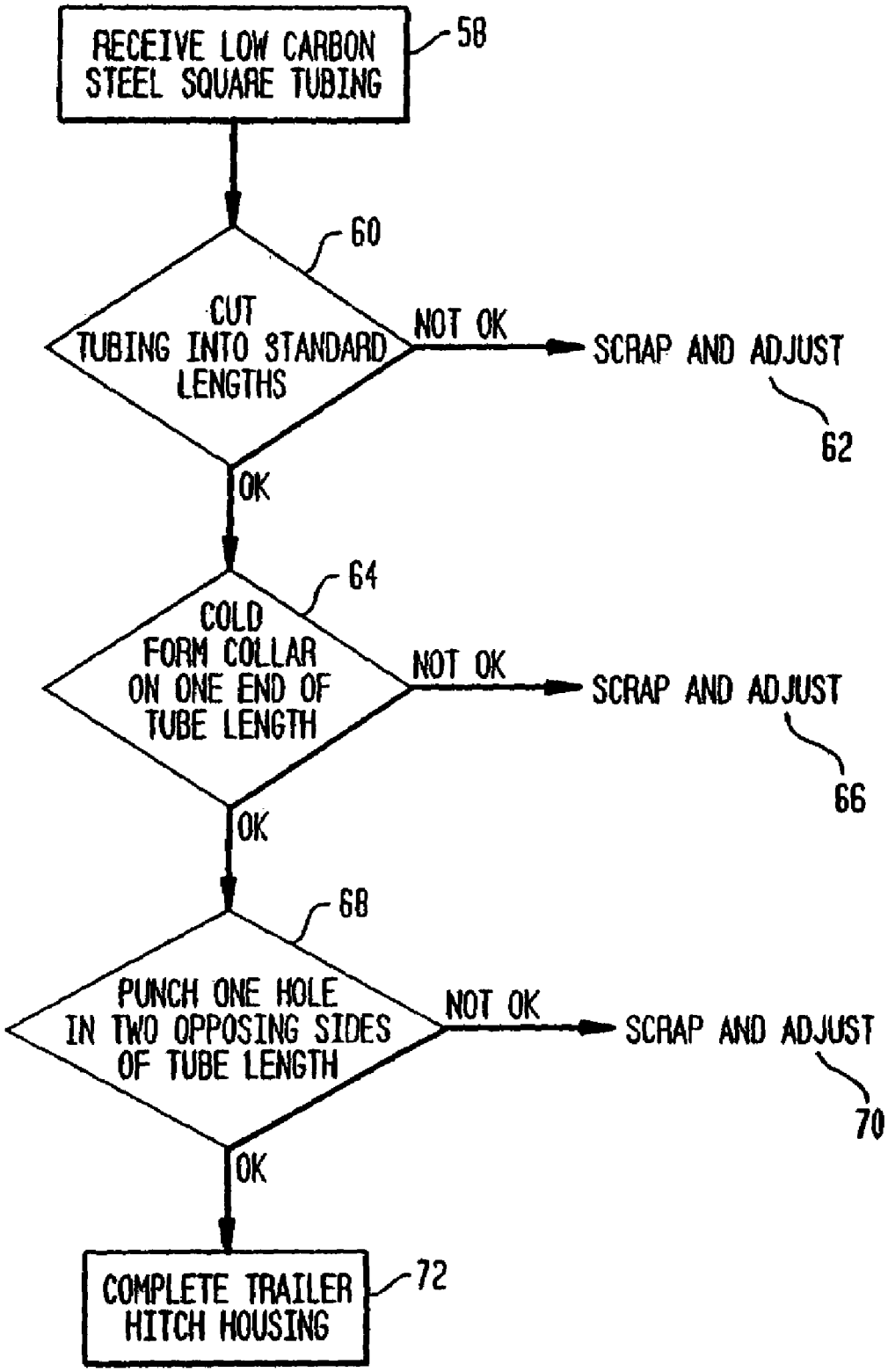
FIG. 8 is a flow diagram of the steps of the overall process of this invention.

FIG. 8 is a flow diagram detailing the overall steps in creating a particular product using the method and apparatus of this invention. After step 58 of receiving the material, the tubing is cut into standard lengths 60. This step of cutting is may need to be controlled to fairly precise tolerances in particular applications in order to reduce sticking in the upper die 28. For instance in cold forming SAE 1018–1021 mild steel, 2.5 inch welded tube with 0.25 inch walls, it was found necessary to control the length of the cut stock to within 0.02 inches, even though required tolerances on the finished part were only ot 0.06 inchs. The actual length and tolerance required vary according to factors such as, but not limited to, tubing hardness, tensile strength, wall thickness and other dimensions.

After step 63 of checking the length and either scrapping of adjusting, the tube has a collar cold formed on one end in step 64. After cold forming in step 64, the part 54 is once again checked for conformity to standards and then appropriately scraped or adjusted in step 66. Parts 54 that pass step 66 then have a hole punched in two opposing sides in step 68. Step 70 checks the punched holes for conformity to standards and scraps or adjusts accordingly, resulting in step 72, the completion of a conforming trailer hitch housing 54.

Figure 9:
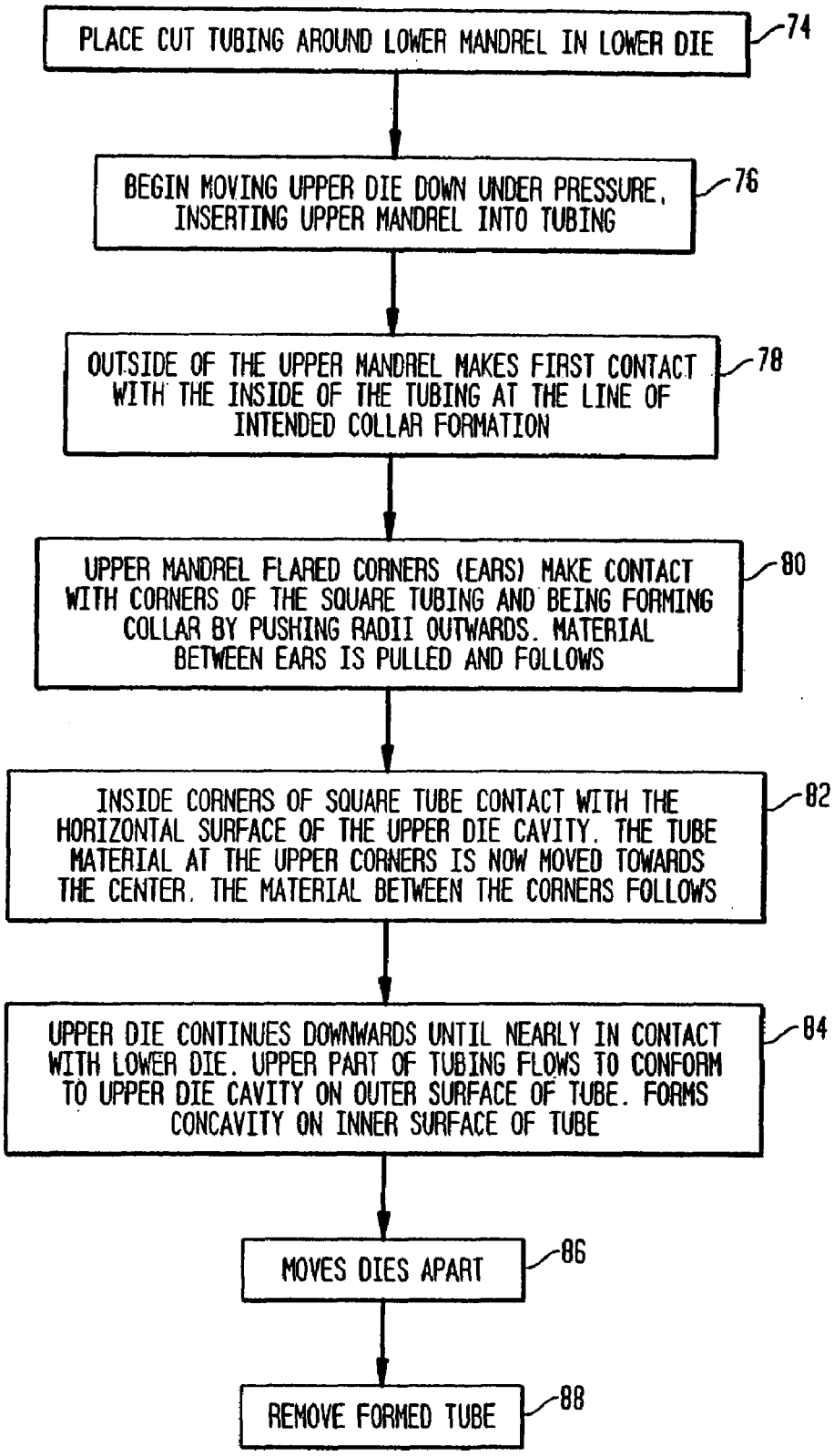
FIG. 9 is a flow diagram of the detailed steps of the process of this invention.

FIG. 9 is a flow diagram detailing the stages of forming of the method of this invention. In step 74, the cut tubing is placed around the lower mandrel in the lower die, with the top of the tubing extending above the top of the lower die by a measured amount. In step 76 the upper die begins moving downwards under pressure, with the upper mandrel being introduced into the top end of the tubing. In step 78, the upper mandrel makes the first contact with the tubing. The first contact occurs between the outer surface of the upper mandrel and the inside surface of the tube substantially at the line of intended collar formation. The motion of the dies towards each other continues and in step 80, the flared corners or ears of the upper mandrel make contact with the inside of the corners of the tubing. The flared corners begin pushing the corner radii of the tubing outwards, beginning the collar formation process. As the dies get closer, the inside corners of the tubing make contact with the horizontal surface of the upper die cavity. The dies continue towards each other, until they are separated by only a few thousands of an inch. The die movement is stopped by suitable spacers in the hydraulic press. At this point the collar on the tube is completely formed, with the outside surface of the collar essentially conforming to the upper die cavity, while the inside surface of the collar is concave. In step 86 the dyes are moved apart. In step 88 the tubing is removed. This step of removing the tubing is accomplished by using a set of wedges to move a pin, which in turn drive the lower mandrel upwards, ejecting the tube from the lower die cavity.

While the embodiments of the invention described above have been with reference to square tubing, one skilled in the art will readily appreciate that substantially the same method, with suitably altered tooling, could be used to form any tubing having regular or irregular polygonal cross section, such as, but not limited to, triangular, rectangular and hexagonal cross-section tubing.

While the above description constitutes the preferred embodiments of the invention, it will be appreciated that the invention is susceptible of modification, variation and change without departing from the proper scope and fair meaning of the accompanying claims.

What is claimed is:

1. A reinforced hollow housing member, comprising:

a tube portion having a relatively constant, polygonal cross-section, a flat inner surface, and a first end and a second end; and a collar portion, integrally attached to said first end, having a cross-section substantially similar to said tube portion but of increased size and having a concave inner surface and an outer surface comprising a flat chamfered base, angled at about 45 degrees and abutting said tube portion.

2. The reinforced hollow housing member of claim 1, wherein said tube portion and said collar portion define a trailer hitch receiver housing.

3. The reinforced hollow housing member claim 1, wherein said polygonal cross-section is generally a square.

4. The reinforced hollow housing member of claim 1 wherein said polygonal cross-section is a four sided shape with ninety (90) degree corners and said collar portion has four interior corners within said hollow housing at said first end with a radius formed in each of the four corners.

5. The reinforced hollow housing member of claim 4 wherein said polygonal cross-section is generally a square.

6. The reinforced hollow housing member of claim 1 wherein said generally polygonal cross-section extends in an axial direction from said first end to said second end and said collar portion has four interior corners within said hollow housing at said first end with an axially extending radius formed in each of the four corners.

7. The reinforced hollow housing member of claim 1 wherein said generally polygonal cross-section extends in an axial direction from said first end to said second end, and said concave inner surface extends in a direction that is generally perpendicular to said axial direction of said cross-section, and said collar portion has four interior corners within said hollow housing at said first end, each of said corners having a formed radius that extends within said hollow housing in said axial direction to the end of said first end.

8. The reinforced hollow housing member of claim 1 wherein said tube portion has an outer surface; said concave inner surface faces said inner surface of said tube portion and said collar portion has an outer surface that extends outwardly beyond said outer surface of said tube portion and has a generally concave outer surface that generally conforms in shape to said inner concave surface.

* * * * *